United States Patent [19]

Southard

[11] Patent Number: 4,807,381

[45] Date of Patent: Feb. 28, 1989

[54] GUN STORAGE AND MAINTENANCE WORK BENCH

[76] Inventor: Robert C. Southard, P.O. Box 94, Locust Grove, Ark. 72550

[21] Appl. No.: 158,945

[22] Filed: Feb. 22, 1988

[51] Int. Cl.[4] ..... F41C 29/00

[52] U.S. Cl. ..... 42/94; 211/64

[58] Field of Search ..... 42/94; 89/37.04; 211/64; 144/286 A; 273/23, 68, 71

[56] References Cited

U.S. PATENT DOCUMENTS

| | | | |
|---|---|---|---|
| 3,288,304 | 11/1966 | Graves | 211/64 |
| 3,329,278 | 7/1967 | Pachmayr | 211/64 |
| 3,477,586 | 11/1969 | Haluska | 211/64 |
| 3,913,746 | 10/1975 | Burton | 211/64 |
| 3,964,013 | 6/1976 | Anderson | 211/64 |
| 4,449,314 | 5/1984 | Sorensen | 42/94 |

OTHER PUBLICATIONS

Sportsman's Guide, Inc., Fall 1987, p. 54, Models G3005, G3042, G3106, G3007.

Gander Mountain, Inc., Fall-Winter 87L, p. 115, Model 189L8911 and 199L8912; p. 116, Model 127L6007.

Outdoor Life, Jan. 1987, p. 11, The Gun Cradle.

Bass Pro Shops; Fall 1986, pp. 83, 86, 87; Gun Racks and Firewood Gun Vise.

*Primary Examiner*—Deborah L. Kyle

*Assistant Examiner*—Richard Klein

*Attorney, Agent, or Firm*—Stephen D. Carver

[57] ABSTRACT

A work bench for firearms including a planar base from which a pair of spaced-apart, rigid sides upwardly project. Each side includes a top having a plurality of grooves. The grooves in each top form a symmetrical array. The sides are disposed oppositely from one another in substantially axial alignment and thus form a plurality of companion pairs of grooves adapted to mate with a firearm. A compliant material such as leather or the like is provided on the side tops and within the arrays and grooves, such that a fire arm may be nondestructively snugly urged into temporary fitting support within said grooves.

5 Claims, 3 Drawing Sheets

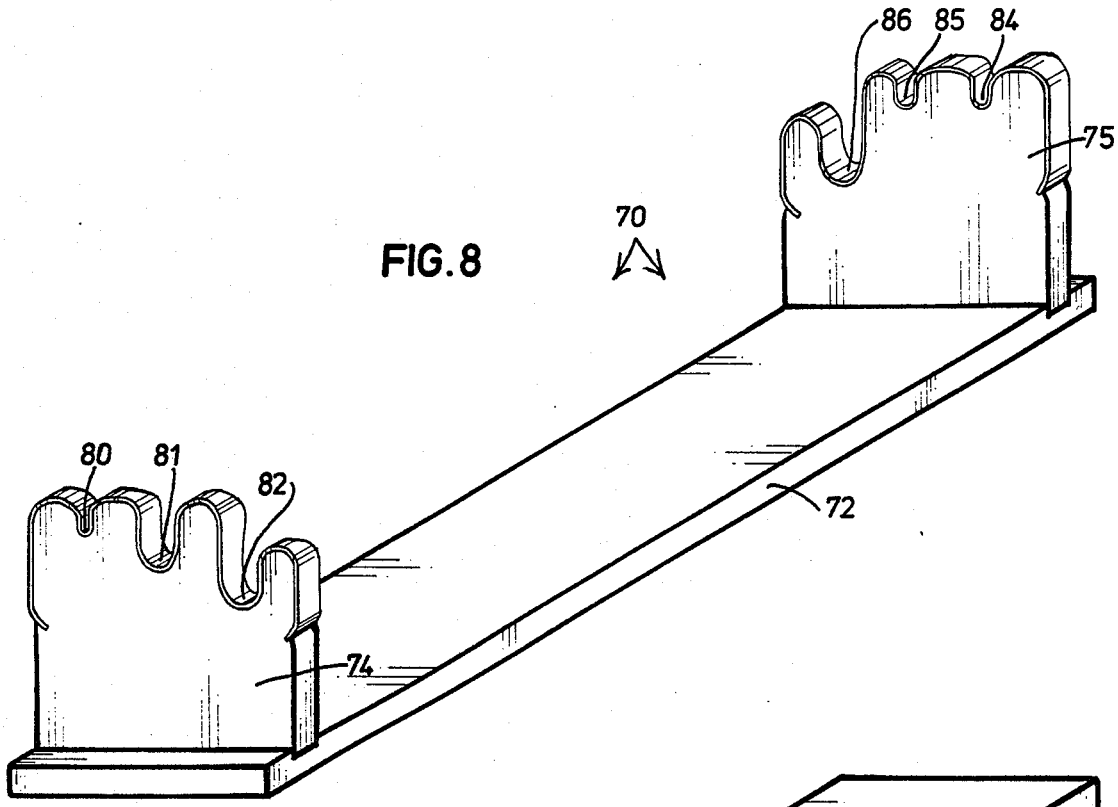
FIG. 8
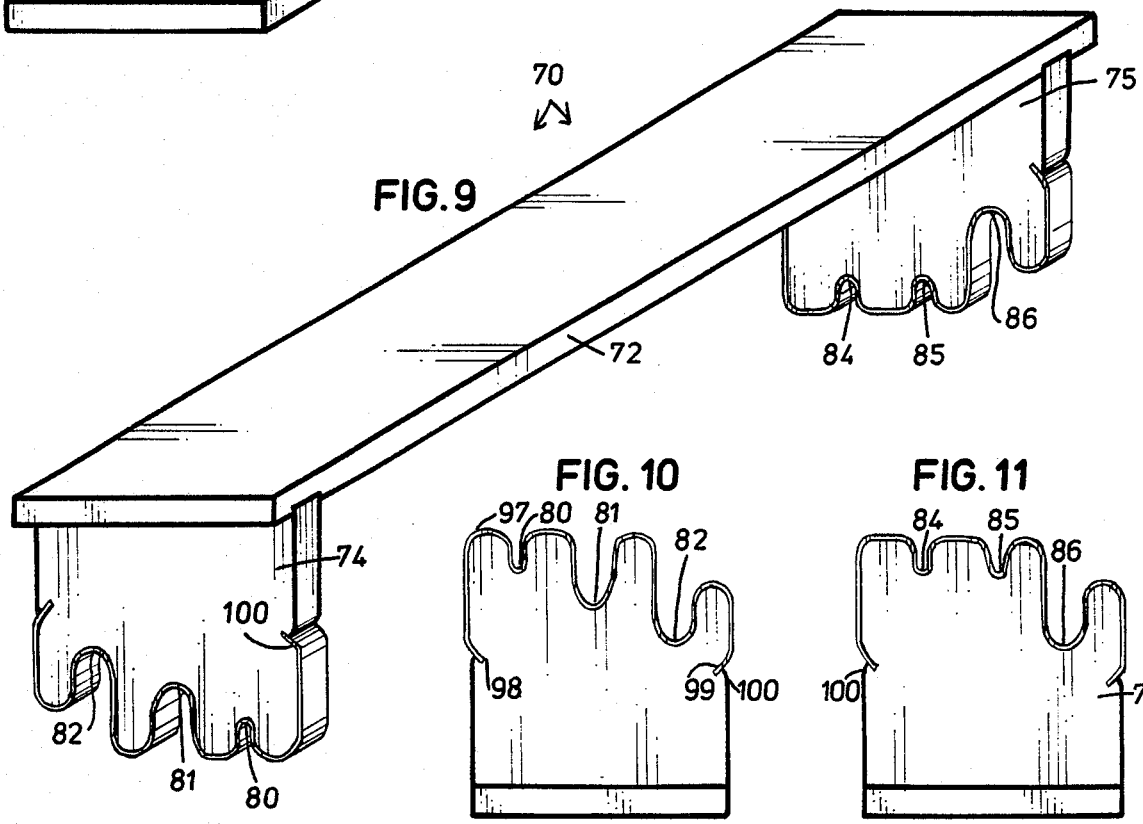
FIG. 9
FIG. 10
FIG. 11

GUN STORAGE AND MAINTENANCE WORK BENCH

BACKGROUND OF THE INVENTION

The present invention relates to firearm work benches. More particularly, the present invention is related to a self-standing work bench or support which aids in the periodic maintenance, servicing, or adjustment of firearms such as rifles, shotguns and the like. The invention is believed properly classified in U.S. utility class 42, subclass 94.

Numerous applications exist for a reliable support bench. As will be recognized by modern gun smiths, hobbyists and the like, proper firearm maintenance may entail any of a variety of tasks, ranging from periodic cleaning and oiling to the installation of optional accessories such as scopes, lanyards, and the like. A good work bench is also necessary for safe firearm repairs.

In the prior art, a plurality of firearm-supporting rest benches are known. They may be called "gun vices", "gun supports", "work benches", "firearm cradles" or the like. Most of the prior art devices include some form of planar surface from which vertical support members extend upwardly. Usually an elevated member receives the stock or barrel of the firearm, and a lower companion member emanating from the base receives the shoulder stock.

Probably the most important type of firearm work bench comprises a form of vice. Such a vice must be strong enough to firmly support a variety of different gun barrels and stocks. Known prior art gun vices usually include jaws with a plurality of teeth for firmly engaging the gun part embraced. Typically, a gun vice will include some form of clamp at its opposite ends to firmly secure the firearm.

Representative of typical prior art gun vices are the vice presently sold under the trademark "MOUNTAIN MEADOW" and a solid mahogany gun vice seen in the Autumn 1987 catalog of *Sportsmans Inc.*

However, a major disadvantage of such prior art vices is that the finish of the firearm disposed thereon may easily become marred or scratched by abrasion against the rigid supporting surfaces. Scratches and other surface blemishes may seriously undermine the value of the firearm, particularly if the gun barrel or metal parts of the gun have been blued. As will be well appreciated by those skilled in the art, reblueing of firearms may be extremely tedious, time-consuming, and expensive.

The compressive jaws of typical prior art gun vices may also seriously damage the expensive treated surface of crafted wooden parts of the firearm, such as the butt or stock. Even plastic stocks are highly susceptible to scratches and other surface mutilations. Hence it would be desirable to provide a work bench which is adapted to firmly retain the firearm in position for maintenance or repair without the use of compressive jaws. It would also be desirable to provide a firearm work bench which would receive the trigger guard so that the firearm may be supported in a variety of selective positions.

SUMMARY OF THE INVENTION

The present invention comprises a unique work bench adapted to conveniently receive and firmly support a firearm for maintenance, repair, modification, or the like. The work bench is adapted to temporarily and securely hold the firearm in one of a number of desired selectable positions without marring or damaging the surface of the metal or other parts of the firearm.

The work bench is preferably machined from plywood or similar soft wood. It includes a rigid, generally rectangular base adapted to be supported upon a suitable surface such as a table, shelf, or the like. A pair of vertically upright sides are firmly secured at the opposite ends of the base. Each side terminates in a top into which a plurality of firearm receptive grooves are cut. These grooves are formed in regular patterns, and each side thus includes an array of grooves.

Each array consists of a plurality of grooves, starting with a smaller groove and ending with larger or deeper grooves, with intermediate grooves disposed therebetween. The array of grooves is identical on both sides, but the sides are reversely disposed, so that the smaller groove of one side is aligned opposite the deeper groove of the opposite side. Hence when a firearm is disposed upon the work bench, its butt end is fitted into the smaller groove on one side, and its stock is similarly fitted into the deeper groove of the opposite side.

The operator may thus correctly position the firearm for work in a desired configuration, either upright, sideways, or upside down, by selecting the appropriate operative pairs of grooves in the arrays. Moreover, if desired, a plurality of different firearms may be simultaneously supported upon the work bench.

Preferably the upper surface of each side is covered with a suitably pliable cushioning material. Each side thus includes a decorative and functional strip of relatively compliant leather fitted neatly upon the top and extending within and between each groove of the array. The leather develops a yieldable pressure to snugly, compressively fit the firearm into the grooves.

Thus a fundamental object of the present invention is to provide a work bench for firearms which can accommodate a plurality of different sizes and types of firearms and which will not mar or damage their surface finish.

A related object is to provide a firearm workbench of the character described which avoids the use of clamping vices or toothed jaws or the like.

Yet another object of the present invention is to provide a relatively simple gun support bench or cradle which can nondestructively and firmly support and hold a firearm in a variety of different configurations. It is a feature of this invention that the stock, pistol grip, breech, trigger guard, forearm support and barrel portions of the firearm can be firmly received within the cradle.

Yet another object of the present invention is to provide a reliable work bench for gunsmiths, firearm enthusiasts, and the like, which is lighter than the firearm being worked on, and which will work with either automatic, single shot, lever action, bolt action, or other firearms.

A still further object of the present invention is to provide a firearm work bench adapted to be manipulated as desired by the user to aid in a variety of routine firearm maintenance operations.

Another object of the present invention is to provide a gun cradle of the character described which is adapted to receive the trigger guard region of a firearm, enabling the gun to be turned sideways and temporarily nondestructively locked in a desired position.

Yet another object is to provide a gun cradle of the character described including appropriately arrayed sides presenting a plurality of shim-receptive holes or notches for firmly and nondestructively embracing a firearm.

A similar object is to provide a gun cradle or repair bench of the character described which will facilitate mounting of a firearm either upside down, sideways, or at a variety of other angles or configurations.

A still further object of the present invention is to provide a firearm work bench of the character described which is ideal for use when mounting or sighting a telescopic scope accessory.

Another object of the present invention is to provide a work bench of the character described which will fit short or long guns with or without scopes.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 8 is a pictorial view of an alternative embodiment thereof;

FIG. 9 is a left end pictorial view of the alternative embodiment in an inverted position;

FIG. 10 is a right end plan view of the alternative embodiment; and,

FIG. 11 is a left end plan view of the alternative embodiment.

DETAILED DESCRIPTION OF THE INVENTION

Figure 1:
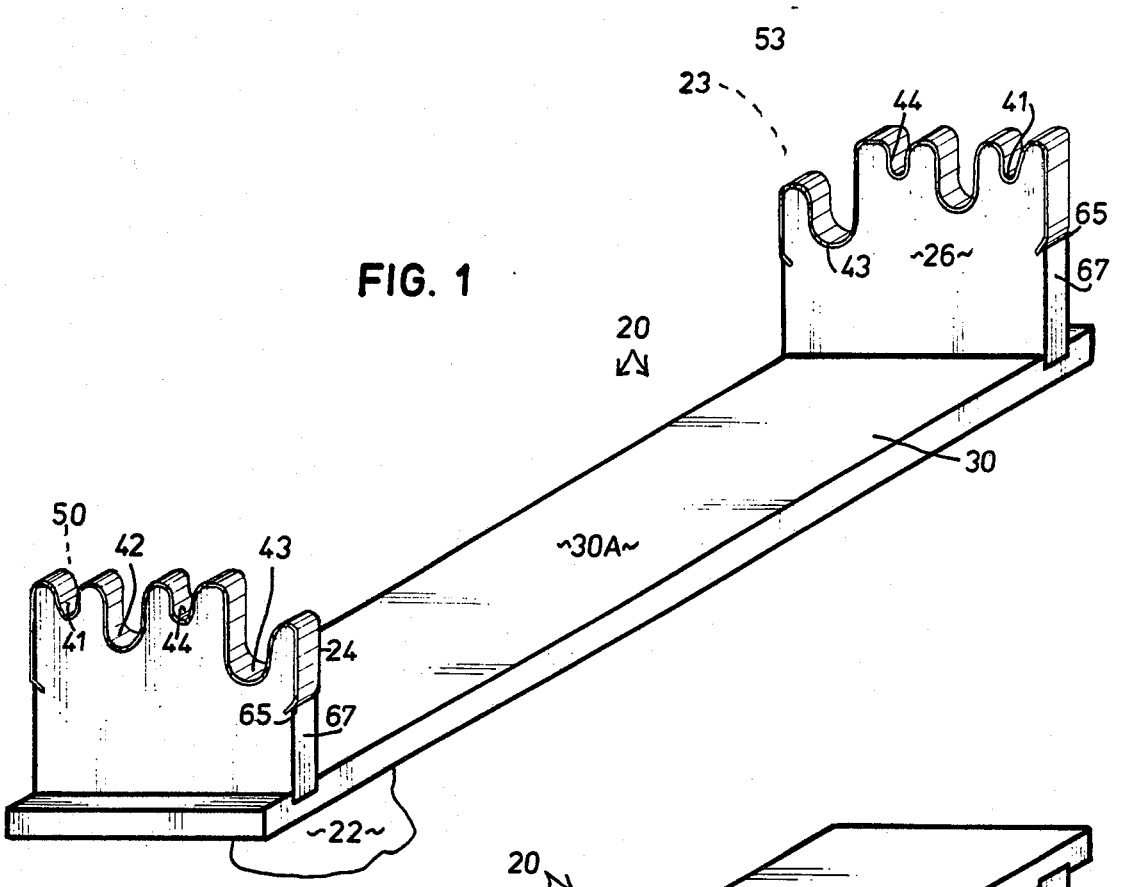
FIG. 1 is a right end pictorial view of my GUN SUPPORT AND MAINTENANCE WORK BENCH constructed in accordance with the preferred embodiment.
Figure 2:
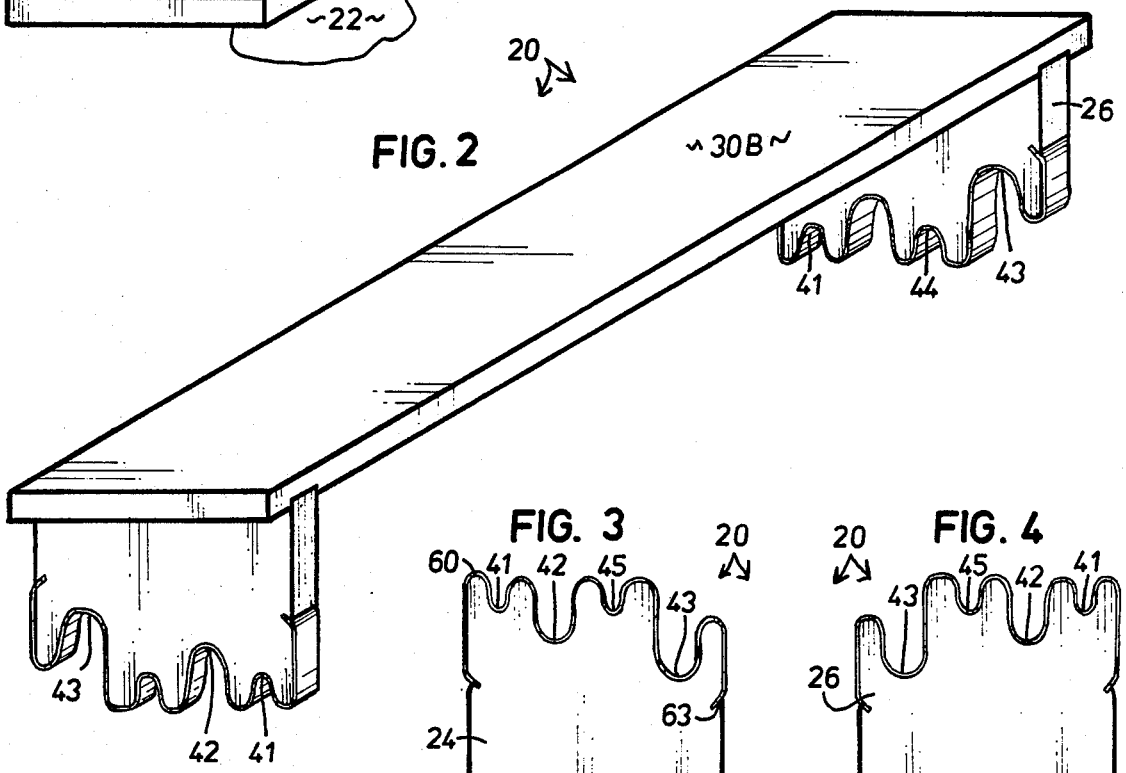
FIG. 2 is a left end pictorial view thereof.

With initial reference directed to FIGS. 1–7 of the appended drawings, a work bench constructed in accordance with the teachings of the present invention has been generally designated by the reference numeral 20. The work bench 20 is adapted to be supported on a generally flat surface such as table 22, and a firearm 23 is adapted to be vertically disposed thereon, supported generally on top of opposing sides 24 and 26.

An elongated, generally rectangular wooden base 30 preferably formed of plywood or the like, includes an upper surface 30A upon which the user may temporarily store parts or the like, and a bottom surface 30B adapted to frictionally contact the supporting surface 22.

The sides 24, 26 are firmly fitted within suitable transverse channels defined near opposite ends 33, 34 respectively of the base plate 30. As best viewed in FIGS. 1 through 4, each side 24, 26 includes a plurality of grooves, such as grooves 41–44 which together form an array. The grooves 41–44 are cut out of the top 24A, 26A (FIG. 5) of sides 24, 26, and are preferably smoothly surfaced prior to varnishing and assembly.

The array of grooves on each side 24, 26 is identical. However, in the best mode, side 24 is positioned reversely from side 26. Thus, as best viewed in FIGS. and 2, a larger groove 43 on one side 26 is substantially axially aligned with and spaced apart from a smaller groove 41 in opposite side 24. Thus the barrel 50 of the firearm may fit within smaller groove 41 while the stock 53 may be fitted into the larger groove 43 in the opposite side of the work bench.

Figure 3:
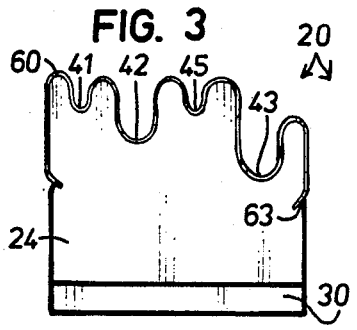
FIG. 3 is a right end plan view thereof.
Figure 4:
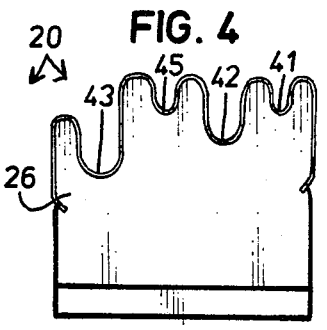
FIG. 4 is a left end plan view thereof.
Figure 5:
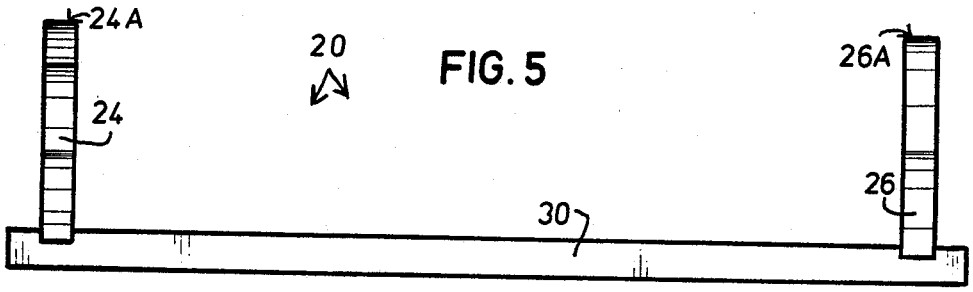
FIG. 5 is a front elevational view thereof.
Figure 6:
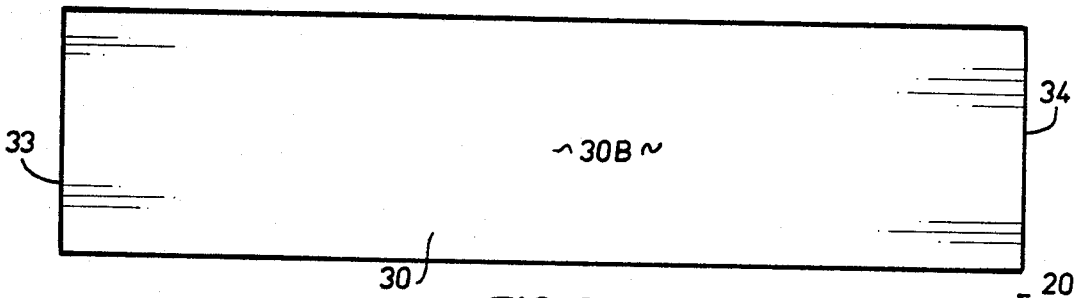
FIG. 6 is a bottom plan view thereof.
Figure 7:
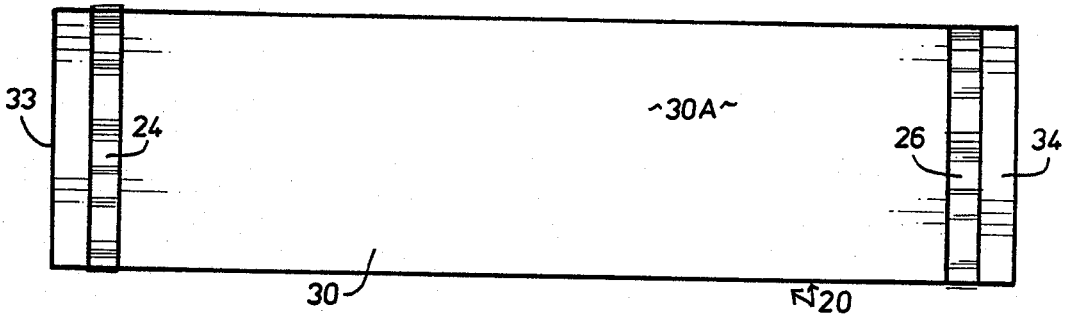
FIG. 7 is a top plan view thereof.

Importantly, a compliant liner, 60, is disposed along the top 24A, 26A of each side. Liner 60 preferably comprises an elongated strip of compliant leather or the like which is fitted across the array of grooves, and firmly secured within each individual groove as best illustrated in FIGS. 3 and 4. The opposite ends 61 and 63 of liner 60 are permanently secured in suitable indentions 65 defined in the sides 67 of the ends. Thus a portion of the leather liner 60 is fit into each groove, so that no matter how the firearm is positioned or manipulated within the work bench, it will be cushioned by leather and protected from scratching or mutilation.

It should also be apparent that by selecting different cooperative pairs of grooves that different sizes of firearms may be accommodated. Thus, for example, a firearm of smaller dimensions could be manipulated between grooves 44 in side 26 and groove 42 in side 24.

Turning now to FIGS. 8–11, an alternative embodiment 70 is thereshown. Embodiment 70 comprises a gun storage and maintenance work bench wherein the arrays of grooves defined in the sides 74, 75 are distinctively arranged. The lower supporting planar surface 72 terminates in sides 74, 75. However, the array in this case is different from embodiment 20 previously discussed. It will be apparent that side 74 includes 3 grooves, 80, 81 and 82, and side 75 includes a distinctive configuration of grooves 84, 85 and 86.

The array formed by grooves 84–86 is different from the array of grooves 80–82. However, as indicated in FIGS. 8 and 9, the side 74 and 75 still generally oppositely direct the groove pairs relative to one another. Larger groove 82 is essentially actually aligned with a smaller groove 84. Similarly, "middle-sized" groove 81 is aligned with groove 85 such that a firearm may be fitted between them. It will be apparent that a firearm may be compressively secured between these arrays of grooves in a variety of different manners or fashions.

As previously discussed, a compliant leather strip 97 is disposed across each array, being firmly glued within each groove and extending between opposite edges of the work bench sides 74 and 75. As best illustrated in FIGS. 10 and 11, the terminal ends 98 and 99 of the liner are secured within suitable notches 100 defined within the ends of each side.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A work bench for securely receiving one or more hand-held long firearms, such as shotguns or rifles, said work bench adapted to stably secure said firearms in any or a plurality of user-selected positions for facilitating routine maintenance, repair, or adjustments, said work bench comprising:

a generally rectangular wooden base adapted to be disposed upon a work table or similar support, said base comprising:

a pair of opposing ends;

an upper surface;

a pair of spaced apart side accommodating rectangular mounting channels disposed near said opposing ends on said upper surface of said base;

a pair of wooden, spaced apart, vertical sides, each of said sides comprising:

a channel engaging bottom adapted to be fitted to one of the aforementioned pair of channels disposed on said base;

a top having an array of depressed grooves varying in depth, width, and curvature, each of said grooves adapted to compressively receive at least one compliant strip of leather and at least a portion of a firearm so that said firearm may be disposed between and upon said sides temporarily firmly held within corresponding aligned grooves defined therewithin by compression against said leather strip(s) without damaging or marring of the surface, finish, or integrity of said firearm;

said grooved side members being aligned such that at least one large groove of one side will be oriented toward at least one smaller groove of the opposite side so as to cooperatively receive the various portions of a firearm such as the barrel, the butt, or the stock; and, a permanent leather strip being affixed across the top of each side within the grooves, the ends of said permanent strip of leather being anchored within terminal slits defined on each opposite upper edges of said sides.

2. The work bench as defined in claim 1 wherein said depressed grooves vary in size so that a larger groove on one of said sides is longitudinally spatially aligned with a smaller groove of the opposing side.

3. The work bench as defined in claim 2 wherein said grooves exhibit slight protrusions enabling a portion of the firearm structure to be held in static communication by the resulting compressive, resistive force, when said firearm is forcibly seated within said groove.

4. A work bench for securely receiving one or more hand-held long firearms, such as shotguns, rifles, or the like, said work bench adapted to stably secure said firearms in any of a plurality of user selected positions thereby effectuating routine maintenance, repair, or adjustments, said work bench comprising:

a generally rectangular wooden base adapted to be disposed upon a work table or similar support, said base comprising:

a pair of opposing ends;

an upper surface;

a pair of spaced apart sides accommodating rectangular mounting channels disposed near said opposing ends on said upper surface of said base;

a pair of wooden, spaced apart, vertical sides, each of said sides comprising:

a channel engaging bottom adapted to be fitted to one of the aforementioned pair of channels disposed on said base;

a top having at least one depressed groove adapted to compressively receive at least one compliant strip of leather and at least a portion of a firearm so that said firearm may be disposed between and upon said sides temporarily firmly held within corresponding aligned grooves defined therewithin by compression against said leather strip(s) without damaging or marring of the surface, finish, or integrity of said firearm;

said grooved side members being aligned such that a large groove of one side will be oriented toward a smaller groove disposed on the opposite side so as to cooperatively receive the various portions of a firearm such as the barrel, the butt, or the stock; and, a permanent leather strip being affixed across the top of each side within the grooves, the ends of said permanent strip of leather being anchored within terminal slits defined on each opposite upper edges of said sides.

5. The work bench as defined in claim 4 wherein said grooves exhibit slight protrusions enabling a portion of the firearm structure to be held in static communication by the resulting compressive, resistive force, when said firearm is forcibly seated within said groove.

* * * * *